United States Patent [19]

Mahmoud

[11] Patent Number: 4,636,251

[45] Date of Patent: Jan. 13, 1987

[54] MATERIALS FOR ELECTRICAL CONTACT

[75] Inventor: Issa S. Mahmoud, Austin, Tex.

[73] Assignee: International Business Machines Corporation, Armonk, N.Y.

[21] Appl. No.: 853,111

[22] Filed: Apr. 17, 1986

[51] Int. Cl.[4] ..... B22F 1/00

[52] U.S. Cl. ..... 75/246; 148/2; 148/12.7 N; 148/162; 419/28; 419/69; 420/451; 420/456

[58] Field of Search ..... 420/456, 451; 75/246; 419/28, 69; 148/2, 12.7 N, 162

[56] References Cited

U.S. PATENT DOCUMENTS 3,277,150 10/1966 Rhys et al. ..... 420/456
4,572,750 2/1986 Masumoto et al. ..... 420/456

*Primary Examiner*—Stephen J. Lechert, Jr.
*Attorney, Agent, or Firm*—Andrea P. Bryant; John L. Jackson; Maurice H. Klitzman

[57] ABSTRACT

A new alloy material for use in electrical contacts is disclosed, comprising by weight

| | |
|---|---|
| Beryllium | 1–2% |
| Palladium | 2–20%; and |

the balance of nickel.

7 Claims, No Drawings

MATERIALS FOR ELECTRICAL CONTACT

TECHNICAL FIELD

The present invention relates to alloys used to form electrical contact areas. More particularly this invention relates to an improved alloy for use as a base for forming contact areas on printed circuit boards.

BACKGROUND ART

It is conventional to use beryllium-copper and phosphorus-copper alloys as base materials for electrical contacts. Such alloys make for reliable contacts and exhibit excellent ductility and strength. Satisfactory use, however, comes at a price. Copper has poor corrosion resistance and tends to diffuse into other elements at a high rate, thus these conventional alloys are sequentially plated with a thick barrier layer and a thick gold layer causing an inherent expense. Nickel is most often used as a barrier layer. Other base materials may be used. Spring steel and alloys such as nickel/silver have proved unsatisfactory due to problems relating to corrosion, tensile strength, formability, and cost.

It is also known to use palladium nickel alloys. They exhibit better properties than pure palladium, but such alloys contain more than 60% by weight of palladium, which, while certainly less costly than gold, represents a great expense.

DISCLOSURE OF INVENTION

The present invention provides a new material for electrical contacts comprising a blend of nickel, palladium, and beryllium. The new base material overcomes the primary prior art problems noted above relating to corrosion resistance and diffusion. No separate barrier layer is required over the base material to prevent its diffusion into a subsequently deposited gold layer.

The new material exhibits improved corrosion resistance even at elevated temperatures and possesses high tensile strength and formability. The alloy is heat treatable and produces a wide range of desirable metallurgical properties.

BEST MODE FOR CARRYING OUT THE INVENTION

The preferred proportions of metals by weight in the blend are:

| | |
|---|---|
| nickel | 80–93% |
| palladium | 2–20% |
| beryllium | 1–2% |

Other elements may be present in trace quantities. The blend is preferably prepared by melting the elements and mixing them in their molten state. The alloy may be cast in a block. The block is then cooled and worked in a series of rolling and annealing steps to strip.

Of course other techniques such as powder metallurgy and sintering may be used to produce the alloy. The component metals must be thoroughly blended to obtain the best results. When the component metals are not so blended there is a tendency in the alloy to break along material borders during rolling.

If rod or wire are the desired form for the alloy they may be drawn from a block of the thoroughly blended component metals.

It has been found that the addition of trace amounts of titanium to the blend has an advantageous effect on the end product. Titanium assists in the nucleation of the alloy materials to so avoid micro segretim of the metals.

The advantageous properties of the new material make it a cost effective alternative for a variety of applications. These properties are believed to be brought about because of the palladium in the blend. Known beryllium-nickel alloys have an undesirable tendency to oxidize.

Tables I and II illustrate the properties of the alloy of the invention in several proportional make-ups. It can be seen that Alloy C having 2% beryllium, 5% palladium and the balance nickel exhibits the best hardness and electrical conductivity for the preferred applications. It was found during preparation of the sample alloys that no heat scale formed on any of the three formulations. However, primarily because of cost considerations it was desirable to have a formulation with the least amount of palladium displaying the desired properties.

Table III shows resistivity values for three samples of Alloy C as measured over 100 days at 85° C. and 85% relative humidity. Table IV records the effects of temperature cycling on three Alloy C samples over the same period of time. That there is so little change in conductivity level after a prolonged period of exposure indicates the excellent corrosion resistance of the preferred alloy composition.

Table V records various mechanical and physical properties of the preferred alloy as measured for different physical conditions. Sample 1 values were measured after the alloy had been rolled to a thickness of 0.010–0.013 mil, without cold or annealing treatments. The second row of values were measured Sample 2 which was cold rolled to half hard temper. Sample 3 was annealed and aged at 900° F. for two hours. Sample 4 was cold rolled and aged to half hard temper at 950° for two hours.

Controls 1–4 are Alloy 360 (BeNi) in similar conditions. Control 3 was aged at 950°.F. for 2.5 hours; Control 4, at 925° F. for 1.5 hours. Alloy 360 was chosen as a control for comparison purposes because its properties are similar to the alloy of the invention. Alloy 360 has the disadvantage of a tendency toward corrosion problems resulting from the formation of beryllium oxide, requiring cleaning to remove and plating to prevent.

As measured for Sample 4, the alloy of the invention requires no plating because the forces shown in column 2 are sufficient to break both the oxide layer and adsorbed gases should these form at the surface.

INDUSTRIAL APPLICABILITY

As above described, the disclosed alloy is particularly useful as a base material for electrical contacts. However, it may also be advantageously used to make electrodes and lead frames for packaging electronic components.

The advantages of the disclosed alloy include lower cost than conventional materials in part because the gold layer of the total contact structure need not be as thick. No barrier layer is required to prevent the base material from diffusing into a subsequent gold layer. As a consequence, no plating effluents or other environmental disadvantages are produced.

While the invention has been described with reference to a particular end use application it will be understood that variations in the method of preparation and the like can be made within the spirit and scope of the invention.

TABLE I

COMPOSITIONS OF ALLOY SAMPLES BY WEIGHT

| | A | B | C |
|---|---|---|---|
| Be | 2.08 | 0.94 | 2.06 |
| Pd | 9.44 | 18.38 | 5.38 |
| Ni | 88.44 | 80.68 | 92.56 |
| | Balance of Impurities | | |

TABLE II

ALLOY HARDNESS AND CONDUCTIVITY

| | A | | B | | C | |
|---|---|---|---|---|---|---|
| | $R_A$ | % IACS | $R_A$ | % IACS | $R_A$ | % IACS |
| As Cast | 68 | <8 | 66 | <8 | 72 | <8 |
| Annealed | 59 | <8 | 54 | <8 | — | — |
| Age 900° F. 30 min. | 63 | <8 | 60 | <8 | 78 | <8 |
| Age 1000° F. 30 min. | 64 | <8 | 64 | <8 | 81 | <8 |

TABLE III

ALLOY C RESISTIVITY
(Milliohm 4 probe measurements)
85° C. at 85% Rel Hum

| Day | 0 | 10 | 18 | 25 | 33 | 53 | 67 | 99 |
|---|---|---|---|---|---|---|---|---|
| 1 | 1.3 | 2.05 | 2.0 | 2.0 | 1.9 | 1.90 | 2.01 | 1.95 |
| 2 | 1.3 | 2.60 | 2.0 | 1.90 | 1.8 | 1.85 | 1.95 | 1.95 |
| 3 | 1.3 | 2.10 | 2.3 | 1.85 | 2.1 | 1.85 | 1.90 | 2.00 |
| 4 | 1.3 | 2.15 | 1.8 | 1.75 | 2.25 | 1.90 | 2.01 | 2.00 |

TABLE IV

ALLOY C RESISTIVITY
Temperature Cycling 0-125° C.

| Day | 0 | 10 | 18 | 25 | 33 | 53 | 67 | 99 |
|---|---|---|---|---|---|---|---|---|
| Sample 1 | 1.3 | 2.25 | 2.0 | 2.65 | 1.75 | 1.90 | 1.85 | 2.00 |
| Sample 2 | 1.3 | 2.05 | 1.8 | 2.80 | 2.35 | 2.15 | 2.00 | 2.20 |
| Sample 3 | 1.3 | 1.85 | 1.8 | 1.65 | 1.70 | 1.80 | 1.95 | 1.85 |

TABLE V

ALLOY C Mechanical Properties

| | Gauge (in) | HRS (KSI) | .2% y.s. (KSI) | UTS (% 2 in) | Elong | Hardness (DPH) | 90% Bend Form R/T (min) L | 90% Bend Form R/T (min) T | Cond. (% IACS) |
|---|---|---|---|---|---|---|---|---|---|
| Sample 1 | .013 | 127.7 | 92.3 | 34.8 | | 231 | 0 | 0 | 5.5 |
| | | 132.3 | 74.7 | 32.4 | | | | | |
| Sample 2 | .010 | 185.9 | 159.8 | 3.3 | | 414 | .7 | .7 | — |
| | | 187.3 | 178.1 | 3.5 | | | | | |
| Sample 3 | .013 | 267.7 | 180.3 | 15.7 | | 599 | — | — | 7.1 |
| | | 270.4 | 183.6 | 15.7 | | | | | |
| Sample 4 | .013 | 298.4 | 227.7 | 9.4 | | 657 | — | — | — |
| | | 302.1 | 273.3 | 7.0 | | | | | |
| CNTL 1 | | 95-130 | 40-70 | 30 | | 106-200 | | | 4 |
| CNTL 2 | | 130-170 | 115-170 | 4 | | 160-383 | | | 4 |
| CNTL 3 | | 215 | 175 | 10 | | 383-598 | | | 6 |
| CNTL 4 | | 245 | 200 | 9 | | 395-695 | | | 6 |

I claim:

1. An alloy comprising a blend of (a) nickel within the range from about 80-93%;

(b) palladium within the range from about 2-20%; and (c) beryllium within the range from about 1-2%; all by weight.

2. The alloy of claim 1 comprising by weight nickel within the range from about 92-93% palladium within the range from about 4.7-5.4%; and beryllium within the range from about 1.09-2.06%.

3. The alloy of claims 1 and 2 including less than 0.01% titanium by weight.

4. A method of making a base material for electrical contacts comprising the steps of:

blending in the following proportions, substantially by weight

| | |
|---|---|
| beryllium | 2% |
| palladium | 5% |
| nickel | 93% and |

forming a block of the blended metals.

5. The method of claim 4 wherein the forming step comprises sintering powered metals and including the additional step of longitudinally drawing the block into rods of predetermined diameter.

6. The method of claim 4 wherein the blending step includes mixing molten metals; the forming step includes casting the molten mixture; and including the additional steps of alternately rolling and annealing the block cast in the forming step.

7. The method of claims 4, 5, or 6 wherein the blending step includes blending less than 0.1% by weight titanium.

* * * * *

UNITED STATES PATENT AND TRADEMARK OFFICE

CERTIFICATE OF CORRECTION

PATENT NO. : 4,636,251

DATED : January 13, 1987

INVENTOR(S) : Issa S. Mahmoud

It is certified that error appears in the above-identified patent and that said Letters Patent is hereby corrected as shown below:

Col. 4, Table V, line 4, delete "HRS" and insert therefor --UTS--;

line 4, delete "UTS Elong" and insert therefor --Elong.--;

line 4, delete "R/T" and insert therefor --R/t--.

Signed and Sealed this

Twenty-fifth Day of July, 1989

*Attest:*

*Attesting Officer*

DONALD J. QUIGG

*Commissioner of Patents and Trademarks*